United States Patent [19]

Kubitzek et al.

[11] 4,054,025

[45] Oct. 18, 1977

[54] PROCESS FOR THE PRODUCTION OF FILAMENT YARNS WITH STATISTICALLY DISTRIBUTED, BROKEN INDIVIDUAL FILAMENTS

[75] Inventors: Harry Kubitzek; Wolfgang Liedtke, both of Dormagen; Herbert Pelousek, Dormagenhacken-broich, all of Germany

[73] Assignee: Bayer Aktiengesellschaft, Leverkusen, Germany

[21] Appl. No.: 707,054

[22] Filed: July 20, 1976

[30] Foreign Application Priority Data

July 23, 1975 Germany ..... 2532843

[51] Int. Cl.[2] ..... D02J 1/08; D02J 1/12

[52] U.S. Cl. ..... 57/157 TS; 57/140 R; 57/157 S

[58] Field of Search ..... 57/2, 3, 6, 34 R, 34 B, 57/51, 34 HS, 55.5, 140 R, 140 BY, 140 J, 144, 156, 157 R, 157 TS, 157 MS, 157 F; 28/1.2, 1.3, 1.4, 59.5, 61, 72.11, 72.12, 72.17

[56] References Cited

U.S. PATENT DOCUMENTS

| | | | |
|---|---|---|---|
| 2,869,967 | 1/1959 | Breen | 57/34 B X |
| 2,895,285 | 7/1959 | Hilbert | 57/34 B X |
| 3,061,998 | 11/1962 | Bloch | 57/157 MS X |
| 3,114,999 | 12/1963 | Coggeshall | 28/59.5 X |
| 3,857,232 | 12/1974 | Heinrich et al. | 57/157 R |
| 3,857,233 | 12/1974 | Cardinal et al. | 57/157 TS X |
| 3,946,548 | 3/1976 | Hino et al. | 57/157 TS X |
| 3,991,549 | 11/1976 | Heinrich et al. | 57/140 R |

*Primary Examiner*—Donald Watkins

*Attorney, Agent, or Firm*—Plumley and Tyner

[57] ABSTRACT

The invention relates to the production of yarns with individual filaments broken in a purely random sequence. This object is achieved by initially interlacing the uniform filament yarns either during spinning and before winding or between the winding bobbin and the drawing zone and subsequently subjecting parts of the outer layers of the interlaced filament strand to brief heat treatment on a contact heater before stretching.

5 Claims, No Drawings

PROCESS FOR THE PRODUCTION OF FILAMENT YARNS WITH STATISTICALLY DISTRIBUTED, BROKEN INDIVIDUAL FILAMENTS

This invention relates to a process for the production of filament yarns with statistically distributed, broken individual filaments from substantially linear synthetic high polymers.

Processes for the production of filament yarns with projecting ends of broken individual filaments have already been developed. Processes of this type include those based on two different starting materials disclosed in British Pat. Specification No. 924,086; German AS 1,263,217, German OS 2,308,031, German OS 2,308,138 and German OS 2,409,053; the process according to German OS 1,660,606 which is only workable under certain conditions, and the process according to German OS 2,313,474 which complicates spinning. The object of these processes is to modify the feel and appearance of sheet-form materials produced from filament yarns to such an extent that they resemble sheet-form materials from fibre yarns. The ends of the individual fibres projecting from the yarn assemblage is obviously a critical factor in any subjective assessment of sheet-form materials from fibre yarns.

An object of the present invention is to produce yarns of this type from uniform filament yarns. To this end, uniform filament yarns are treated in the simplest possible manner before final drawing in such a way that so-called hair yarns, i.e. filament yarns with ends projecting in a statistical sequence, i.e. with individual filaments broken in a purely random sequence, are formed during the drawing process.

According to the invention, this object is achieved by initially interlacing the uniform filament yarns, either during spinning and before winding, or between the winding bobbin and the drawing zone, and subsequently subjecting parts of the outer layers of the interlaced filament strand to brief heat treatment on a contact heater. Accordingly, the process according to the invention comprises the combination of a. producing an interlaced filament strand with irregularly disorganised individual filaments which has not been fully drawn, thermally overcrystallising the outer zones of the disorganised, interlaced filament strand, and c. drawing the filament strand thus pretreated.

Accordingly, the present invention relates to a process for producing filament yarns with projecting ends of broken individual filaments, distinguished by the fact that filament yarns which have not been fully drawn are first interlaced, subsequently subjected to partial overstressing under heat on a contact heater, and finally are fully drawn.

The effect of interlacing is that all the filaments of the filament yarn are locally subjected in a random sequence to the subsequent thermal overstressing stage and are broken with equal probability during the drawing operation. In addition, interlacing prevents so-called group breaks, i.e. the simultaneous breakage of several filaments, standardises tension during the drawing operation and prevents stray filaments from being wound onto the godets, because all the individual filaments are bound into the filament strand.

Adequate safety of travel is obtained even in the case of filament strands which, according to the hook drop test described in U.S. Pat. No. 2,985,995, have five and more entanglements per metre. The type of jet used, the air pressure filament tension and preparation, and other measures which have to be taken in order to reach interlacing levels of this order in the undrawn filament yarns to be interlaced are not the subject of the invention and do not have to be described in detail here because they are generally known, for example from U.S. Pat. Nos. 2,985,995; 3,069,836 and 3,110,151. They also vary with the denier and with the type of material to be treated.

The partial thermal overstressing, in which the filament yarns are briefly overheated, produces the above-mentioned thermal overcrystallisation of the outer zones of the interlaced filament strand.

Any conventional heating surfaces, such as godets, yokes, mandrels, hot-pins, and edges, may be used for the thermal overstressing of the outer layers of the interlaced filament strands which always has to be carried out before final drawing.

It is not possible to lay down any general rules for the thermal overstressing of the outer zones of the filament strand. The temperature to be applied is governed on the one hand by the type of filament material and its orientation (initial drawing level) and on the other hand by the type of heater used and by the contact time of the filament yarn with the heater. Heating godets provide for a relatively wide temperature range. In their case, the contact time may be controlled both through the rate of travel and also through the number of loops or turns.

It is obvious that, in principle, the production of "hair yarns" by the combination of interlacing, partial thermal overstressing on a contact heater and drawing may be applied to any known filament yarns which have not been fully drawn. It is particularly advantageous to use so-called preoriented filament yarns which, by virtue of their reduced filament diameter, are easier to interlace and, by virtue of their greater preorientation, can still be further drawn to a considerable extent even despite thermal overstressing, so that in this case the projecting ends of the broken individual filaments do not appear as relatively thick bristles. The process may, of course, also be applied to filament yarns which consist of two or more physically or chemically different individual filaments or whose individual filaments have a multicomponent structure.

Although the process steps according to the invention which provide the required result, namely a. interlacing b. thermal overstressing of parts of the outer layers, and c. final drawing have to be carried out in the order indicated, they may be applied individually or in combinations of a) with b), of b) with c) or even of a), b) and c).

A special, more voluminous type of "hair yarn" is obtained by the process according to the invention if the interlaced, partially thermally overstressed and drawn filament strand is interlaced for a second time. By this second interlacing stage, which may be carried out both in one operation with drawing and also separately thereafter, the broken individual filaments are blown into additional individual filament loops so that a "hair loop yarn" is formed.

Stretching may also be carried out by simultaneous or consecutive draw-texturing. Processes of this kind are described in the literature, more especially for false twist texturing.

The following Examples are to further illustrate the invention without limiting it.

EXAMPLE 1

A preoriented filament yarn with a denier of dtex 270 /36 was produced in known manner using a spinning extruder from polyethylene terephthalate granulate with a relative solution viscosity of 1.76, as measured on a 1% solution in orthochlorophenol, and wound into package form at a rate of 3400m/minute. The packages were delivered to a draw twisting maching where the filament yarn was interlaced before the delivery roll in such a way that 5 to 7 entanglements per metre, measured by the hook drop test, were produced.

The interlaced filament strand was then delivered to a heated, 11 cm diameter godet with an idler roller, stretched between that godet and a second godet with an idler roller which had been heated to 160° C and was rotating at 400 m/minute, and wound onto a cop by way of ring travellers. The drawing ratio was 1:1.7. Under these conditions, smoothly travelling "hair yarns" with a large number of split individual filaments were obtained with the following process conditions prevailing at the delivery godet.

| Temperature of the delivery godet (° C) | No. of loops around the delivery godet |
|---|---|
| 150 | 4 |
| 160 | 4 |
| 170 | 3 |
| 180 | 3 |
| 190 | 2 |
| 200 | 2 |
| 205 | 2 |
| 210 | 1 |
| 215 | 1 |
| 220 | 1 |

EXAMPLE 2

Polyethylene terephthalate granulate was spun in the same way as in Example 1, but the yarn was interlaced before the winding unit and guided over a 40 cm long heating plate. The degree of interlacing as determined by the hook drop test amounted to between 15 and 20 entanglements per metre. Non-interlaced filament yarn was used for comparison. The filament yarns produced at different temperatures of the heating plate were drawn in a ratio of 1: 2.0 in a draw twisting machine between a delivery godet heated to 90° C, around which they were looped 6 times, and a stretching godet heated to 160° C, around which they were again looped 6 times, and were then interlaced for a second time between the stretching godet and the cop.

Under these conditions, the filament yarns which had not been interlaced during spinning could not be drawn, whereas the filament yarns that had been interlaced showed an increasing number of individual filament ends and loops projecting from the filament strand with increasing heating yoke temperature. Smoothly travelling "hair loop yarns" with strengths of 4.4 g/dtex and elongations at break of 18% were obtained in this way. In this series of tests, the yarns produced at heating yoke temperatures ranging from room temperature to 160° C showed only a very weak and inadequate hair loop characteristic, the yarns produced at a temperature in the range of from 160° to 220° C showed a moderate hair loop characteristic, and the filament yarns wound at a heating yoke temperature above 220° C showed a favourable to strong hair loop characteristic.

We claim

1. A process for the production of filament yarns with projecting ends of broken individual filaments which comprises first interlacing filament yarns which have been partially but not fully drawn and subsequently subjecting said filament yarns to partial thermal overstressing on a contact heater and, finally, fully drawing of said filament yarns.

2. The process for the production of filament yarns with projecting ends and loops of broken individual filaments according to claim 1 wherein the filament yarns are additionally interlaced.

3. The process for the production of filament yarns with projecting ends of broken individual filaments according to claim 1 wherein filament yarns which have not been fully drawn are first interlaced, subsequently subjected to partial thermal overstressing on a contact heater and, finally, are subjected to draw-texturing.

4. The process for the production of filament yarns with projecting ends and loops of broken individual filaments according to claim 3 wherein the filament yarns are additionally interlaced.

5. Filament yarns with projecting ends of broken individual filaments produced by the process claimed in claim 1.

* * * * *